US011692470B2

(12) United States Patent
Herwat et al.

(10) Patent No.: US 11,692,470 B2
(45) Date of Patent: Jul. 4, 2023

(54) EXHAUST SYSTEM AND MUFFLER

(71) Applicant: Tenneco Automotive Operating Company Inc., Lake Forest, IL (US)

(72) Inventors: Brett Herwat, Jackson, MI (US); Boyd Boehlke, Jackson, MI (US); Bradley Smith, Ann Arbor, MI (US); Jason Johnson, Brighton, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 0 days.

(21) Appl. No.: 17/616,803

(22) PCT Filed: Jun. 4, 2020

(86) PCT No.: PCT/US2020/036076
§ 371 (c)(1),
(2) Date: Dec. 6, 2021

(87) PCT Pub. No.: WO2020/247597
PCT Pub. Date: Dec. 10, 2020

(65) Prior Publication Data

US 2022/0220874 A1 Jul. 14, 2022

Related U.S. Application Data

(60) Provisional application No. 62/858,546, filed on Jun. 7, 2019.

(51) Int. Cl.
*F01N 1/12* (2006.01)
*F01N 13/08* (2010.01)

(52) U.S. Cl.
CPC ..... *F01N 1/12* (2013.01); *F01N 13/08* (2013.01); *F01N 2470/10* (2013.01);
(Continued)

(58) Field of Classification Search
CPC ..... F01N 1/12; F01N 13/04; F01N 2470/10; F01N 2470/14; F01N 2470/16
See application file for complete search history.

(56) References Cited

U.S. PATENT DOCUMENTS 6,478,340 B1 * 11/2002 Butler ..... F16L 41/023 60/323
2004/0154289 A1 8/2004 Schlossarczyk et al.
(Continued)

FOREIGN PATENT DOCUMENTS

CN 105164381 A 12/2015
CN 108026807 A 5/2018
(Continued)

OTHER PUBLICATIONS

International Search Report and the Written Opinion of the International Searching Authority for Counterpart PCT/US2020/036076, dated Sep. 11, 2020, 13 pages.
(Continued)

*Primary Examiner* — Jonathan R Matthias
(74) *Attorney, Agent, or Firm* — McGarry Bair PC

(57) ABSTRACT

A muffler for use with an internal combustion engine is provided. The muffler includes a first tube configured to receive a first exhaust stream. The first tube includes a first inlet portion, a first outlet portion spaced apart from the first inlet portion, and a first intermediate portion extending between the first inlet portion and the first outlet portion. The muffler also includes a second tube configured to receive a second exhaust stream. The second tube includes a second inlet portion, a second outlet portion spaced apart from the second inlet portion, and a second intermediate portion extending between the second inlet portion and the second outlet portion. The first intermediate portion and the second intermediate portion cross each other, are at least partially
(Continued)

stacked on each other, and are in fluid communication with each other.

20 Claims, 12 Drawing Sheets

(52) U.S. Cl.
CPC ..... *F01N 2470/14* (2013.01); *F01N 2470/16* (2013.01); *F01N 2470/20* (2013.01)

(56) References Cited

U.S. PATENT DOCUMENTS

2007/0045041 A1* 3/2007 Krueger ..... F01N 13/1894 181/251
2007/0068150 A1* 3/2007 Mueller ..... F01N 13/1872 60/323
2010/0146955 A1* 6/2010 Tuch ..... F01N 13/08 60/324
2014/0166393 A1* 6/2014 Butler ..... F01N 1/10 181/296
2016/0024989 A1 1/2016 Eichmueller et al.
2018/0202344 A1* 7/2018 Klemenc ..... F01N 1/166
2019/0107019 A1 4/2019 Ostromecki et al.

FOREIGN PATENT DOCUMENTS

CN 109630235 A 4/2019
CN 110454264 A 11/2019
JP 2000248947 A 9/2000
JP 3740879 B2 2/2006
KR 1020070108584 A 11/2007

OTHER PUBLICATIONS

Chinese Office Action for Counterpart CN202080042097.6, dated Apr. 19, 2023, 8 Pages.

* cited by examiner

B-B

A-A

SECTION S–S'

EXHAUST SYSTEM AND MUFFLER

CROSS-REFERENCE TO RELATED APPLICATIONS

This application is a National Phase application of International Application No. PCT/US2020/036076, filed Jun. 4, 2020, which claims the benefit of U.S. Provisional Patent Application 62/858,546 filed Jun. 7, 2019, both of which are hereby incorporated by reference in their entirety.

TECHNICAL FIELD

The present disclosure relates to an exhaust system for an engine. More particularly, the present disclosure relates to a muffler of an exhaust system for an engine.

BACKGROUND

An exhaust system for an internal combustion engine employs a muffler in order to dampen exhaust noise generated by the engine. In a multi-cylinder internal combustion engine, two different exhaust streams can be generated by two different banks of cylinders. The two exhaust streams can flow into the muffler from two different portions of an exhaust manifold through two different exhaust pipes. In many situations, the two exhaust streams can collide and mix within the muffler and can further exit the muffler in two different exhaust stream or a combined single exhaust stream. The collision and mixing of the two exhaust streams can result in an undesired backpressure within the muffler. In some situations, the collision and mixing of the two exhaust streams can result in an increased exhaust noise within the muffler. Hence, there is a need for an improved muffler for such applications.

Given description covers one or more above mentioned problems and discloses a method and a system to solve the problems.

SUMMARY

In an aspect of the present disclosure, a muffler for use with an internal combustion engine is provided. The muffler includes a first tube. The first tube includes a first inlet portion defining a first inlet configured to receive a first exhaust stream. The first inlet portion is disposed along a first axial plane. The first tube also includes a first outlet portion defining a first outlet and disposed along a second axial plane. The second axial plane is vertically spaced from the first axial plane. The first tube further includes a first intermediate portion extending from the first inlet portion to the first outlet portion. The first intermediate portion is fluidly coupled to the first inlet portion and the first outlet portion. The muffler also includes a second tube. The second tube includes a second inlet portion defining a second inlet configured to receive a second exhaust stream. The second inlet portion is spaced apart from the first inlet portion and disposed along a third axial plane. The second tube also includes a second outlet portion spaced apart from the first outlet portion and defining a second outlet. The second outlet portion is disposed along a fourth axial plane that is vertically spaced from the third axial plane. The second tube further includes a second intermediate portion extending from the second inlet portion to the second outlet portion. The second intermediate portion is fluidly coupled to the second inlet portion, the second outlet portion and the first intermediate portion. The first intermediate portion and the second intermediate portion cross each other and are at least partially stacked on each other.

In another aspect of the present disclosure, a muffler for use with an internal combustion engine is provided. The muffler includes a first tube configured to receive a first exhaust stream. The first tube includes a first inlet portion, a first outlet portion spaced apart from the first inlet portion, and a first intermediate portion extending between the first inlet portion and the first outlet portion. The muffler also includes a second tube configured to receive a second exhaust stream. The second tube includes a second inlet portion, a second outlet portion spaced apart from the second inlet portion, and a second intermediate portion extending between the second inlet portion and the second outlet portion. The first intermediate portion and the second intermediate portion cross each other, are at least partially stacked on each other, and are in fluid communication with each other.

In yet another aspect of the present disclosure, an exhaust system for use with an internal combustion engine having a first row of cylinders and a second row of cylinders is provided. The exhaust system includes a first pipe adapted to receive a first exhaust stream from the first row of cylinders. The exhaust system also includes a second pipe adapted to receive a second exhaust stream from the second row of cylinders. The exhaust system further includes a muffler. The muffler includes a first tube fluidly coupled to the first pipe. The first tube includes a first inlet portion defining a first inlet configured to receive the first exhaust stream. The first inlet portion is disposed along a first axial plane. The first tube also includes a first outlet portion defining a first outlet and disposed along a second axial plane. The second axial plane is vertically spaced from the first axial plane. The first tube further includes a first intermediate portion extending from the first inlet portion to the first outlet portion. The first intermediate portion is fluidly coupled to the first inlet portion and the first outlet portion. The muffler also includes a second tube fluidly coupled to the second pipe. The second tube includes a second inlet portion defining a second inlet configured to receive the second exhaust stream. The second inlet portion is spaced apart from the first inlet portion and disposed along a third axial plane. The second tube also includes a second outlet portion spaced apart from the first outlet portion and defining a second outlet. The second outlet portion is disposed along a fourth axial plane that is vertically spaced from the third axial plane. The second tube further includes a second intermediate portion extending from the second inlet portion to the second outlet portion. The second intermediate portion is fluidly coupled to the second inlet portion, the second outlet portion and the first intermediate portion. The first intermediate portion and the second intermediate portion cross each other and are at least partially stacked on each other.

Other features and aspects of this disclosure will be apparent from the following description and the accompanying drawings.

DETAILED DESCRIPTION

Aspects of the disclosure generally relate to a muffler that provides a simple, efficient, and cost-effective method of reducing exhaust noise downstream of the muffler. The muffler includes first and second tubes that provide substantially separate flow paths for multiple exhaust streams. The first and second tubes reduce direct collision between the multiple exhaust streams, which in turn reduces drag and backpressure within the muffler. Also, as the multiple exhaust streams cross each other in a common chamber located between the first and second tubes, the common chamber provides limited interaction and mixing of the multiple exhaust streams. This results in cancelling half engine order noise generated in each of first and second pipes, which reduces fluid noise within the muffler. As a result, overall exhaust noise is reduced downstream of the muffler relative to a conventional muffler having substantial interaction and mixing of different exhaust streams.

Figure 1:
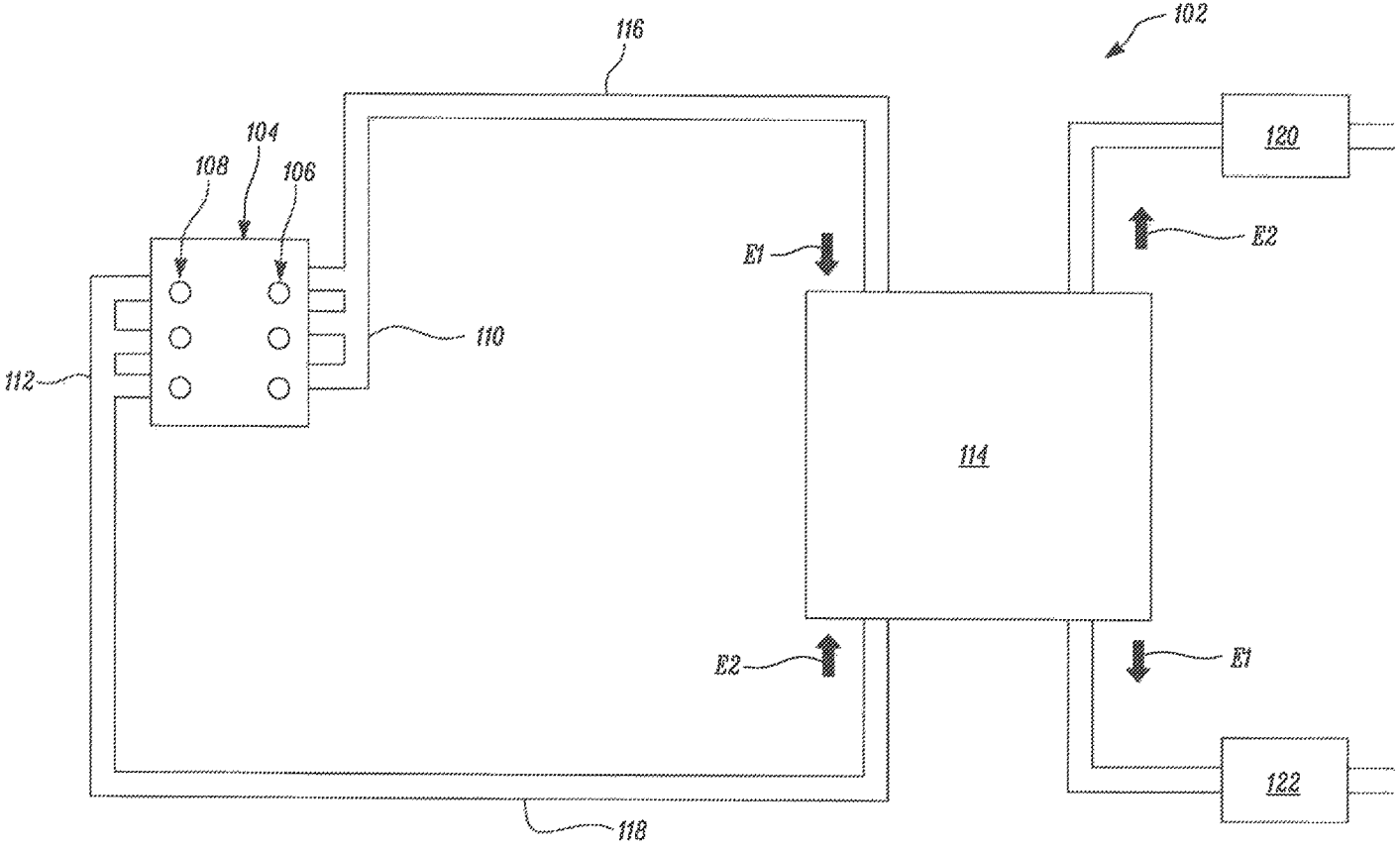
FIG. 1 is an exemplary schematic representation of an exhaust system associated with an engine, according to an aspect of the present disclosure.

Wherever possible, the same reference numbers will be used throughout the drawings to refer to same or like parts. Referring to FIG. 1, an exemplary schematic representation of an exhaust system 102 coupled to an engine 104 is illustrated. The engine 104 can be any internal combustion engine powered by a fuel, such as gasoline, diesel, natural gas, or any other fuel, or a combination thereof. As illustrated, the engine 104 is a multi-cylinder engine. Accordingly, the engine 104 includes two rows of cylinders, such as a first row of cylinders 106 and a second row of cylinders 108. The first row of cylinders 106 and the second row of cylinders 108 can correspond to two cylinder banks of the engine 104. In the illustrated embodiment, each of the first row of cylinders 106 and the second row of cylinders 108 includes three cylinders. In other embodiments, each of the first row of cylinders 106 and the second row of cylinders 108 can include any number of cylinders, based on application requirements. Also, in the illustrated embodiment, the engine 104 has a V-configuration. In other embodiments, the engine 104 can have any other configurations, such as an inline or straight configurations, or can be based on other application requirements.

The exhaust system 102 includes a first exhaust manifold 110 and a second exhaust manifold 112. The first exhaust manifold 110 is coupled to the first row of cylinders 106. Accordingly, the first exhaust manifold 110 is adapted to receive a first exhaust stream "E1" from the first row of cylinders 106. The second exhaust manifold 112 is coupled to the second row of cylinders 108. Accordingly, the second exhaust manifold 112 is adapted to receive a second exhaust stream "E2" from the second row of cylinders 108. Additionally, the engine 104 can include components and/or systems not described herein, such as an engine block, a cylinder head, a valve assembly, an intake manifold, a cooling system, a lubrication system, an air delivery system, a turbocharger, a supercharger, or other peripherals based on application requirements.

The exhaust system 102 also includes a muffler 114. The muffler 114 is coupled to each of the first exhaust manifold 110 and the second exhaust manifold 112. More specifically, the muffler 114 is coupled to the first exhaust manifold 110 via a first pipe 116. The first pipe 116 is adapted to provide flow of the first exhaust stream "E1" from the first exhaust manifold 110 to the muffler 114. Also, the muffler 114 is coupled to the second exhaust manifold 112 via a second pipe 118. The second pipe 118 is adapted to provide flow of the second exhaust stream "E2" from the second exhaust manifold 112 to the muffler 114. The muffler 114 is adapted to reduce exhaust noise downstream of each of the first pipe 116 and the second pipe 118.

The exhaust system 102 also includes a number of downstream components coupled to the muffler 114, such as a first auxiliary muffler 120 and a second auxiliary muffler 122. The first auxiliary muffler 120 is adapted to receive the first exhaust stream "E1" from the muffler 114. The second auxiliary muffler 122 is adapted to receive the second exhaust stream "E2" from the muffler 114. Additionally, the exhaust system 102 can include one or more aftertreatment components/systems (not shown), such as a Diesel Particulate Filter (DPF) unit, a Diesel Oxidation Catalyst (DOC) unit, a Diesel Exhaust Fluid (DEF) unit, a Selective Catalytic Reduction (SCR) unit, a tailpipe, or other components based on application requirements.

Figure 2A:
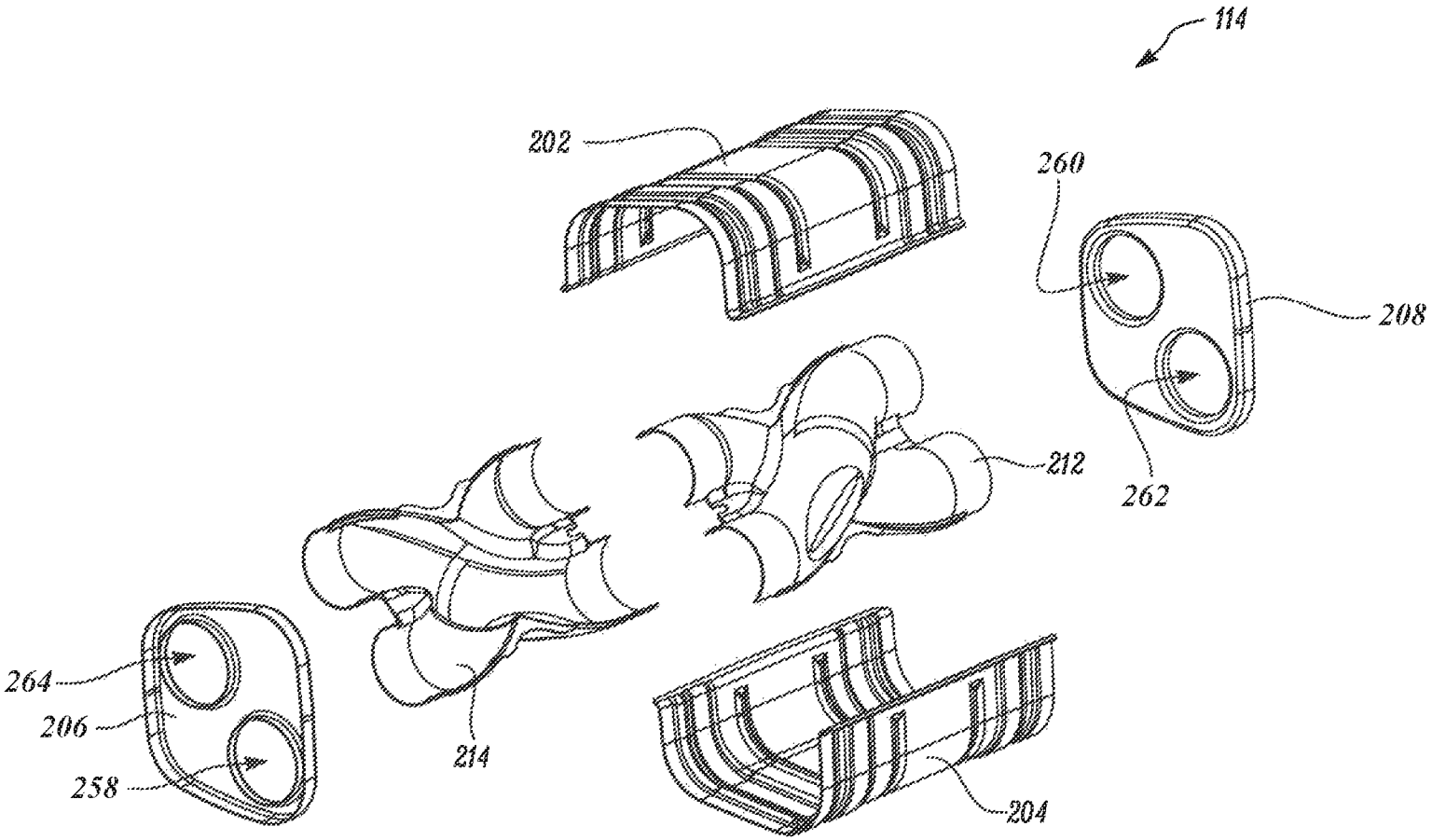
FIG. 2A is an exploded perspective view of a muffler of the exhaust system of FIG. 1, according to an aspect of the present disclosure.

Referring to FIG. 2A, an exploded perspective view of the muffler 114 is illustrated. The muffler 114 includes a first casing 202 and a second casing 204. In the illustrated embodiment, each of the first casing 202 and the second casing 204 has a substantially U-shaped configuration. In other embodiments, one or more of the first casing 202 and the second casing 204 can have any other configuration, such as a semi-circular configuration, a curved configuration, a stepped configuration, or other configuration based on application requirements. Each of the first casing 202 and the second casing 204 can be manufactured using any process, such as stamping, forging, casting, additive manufacturing, or other manufacturing process based on application requirements.

The muffler 114 also includes a first plate 206 and a second plate 208. In the illustrated embodiment, each of the first plate 206 and the second plate 208 has a substantially flat and trapezoidal configuration. In other embodiments, one or more of the first plate 206 and the second plate 208 can have any other configuration, such as a bent configuration, an angled configuration, a stepped configuration, a circular configuration, an elliptical configuration, a rectangular configuration, or other configuration based on application requirements. Each of the first plate 206 and the second plate 208 can be manufactured using any process, such as stamping, forging, casting, additive manufacturing, or other manufacturing process based on application requirements. Each of the first casing 202, the second casing 204, the first plate 206, and the second plate 208 is coupled to one other to form a housing 210 (shown in FIG. 2B) of the muffler 114 and will be explained in more detail later. Each of the first casing 202, the second casing 204, the first plate 206, and the second plate 208 can be coupled to one other using any coupling process, such as welding, bolting, riveting, or other coupling process.

The muffler 114 further includes a first inner section 212 and a second inner section 214. The second inner section 214 has a configuration substantially similar to a configuration of the first inner section 212. Each of the first inner section 212 and the second inner section 214 has a substantially curved and X-shaped configuration. In the illustrated embodiment, each of the first inner section 212 and the second inner section 214 is manufactured by stamping process, rather than by a traditional casting method. In traditional cross-pipe muffler applications, the cast part was die-locked, which prevented the muffler pipes from being stamped. One of the issues solved by the present disclosure is that the present disclosure allows the muffler pipes to be stamped as two halves (i.e. first inner section 212 and second inner section 214) and later assembled. That said, it is possible that in other embodiments, each of the first inner section 212 and the second inner section 214 can be manufactured using any other process, such as forging, additive manufacturing, or other manufacturing process based on application requirements.

Each of the first inner section 212 and the second inner section 214 is coupled to one other to form a first tube 216 (shown in FIG. 2B) and a second tube 218 (shown in FIG. 2B) of the muffler 114. Each of the first inner section 212 and the second inner section 214 can be coupled to one other using any coupling process, such as welding, bolting, riveting, or other coupling process. In one example, the two sections 212, 214 can be connected by a continuous relief 245 (shown best in FIG. 2G, 2H) that traverses the outside surface of the tubes 216, 218 and joins the two tubes 216, 218 together. As shown in FIG. 2G, 2H, the use of multiple types of welds can be used to weld the two tubes 216, 218. For example, the use of a central "clam shell joint" 250 can be used across a portion of the tubes 216, 218 and use of an overlapping or "shoe box joint" 252 can be used at the outboard edges. The outboard edges can be located on both sides of the clam shell joint.

Figure 2B:
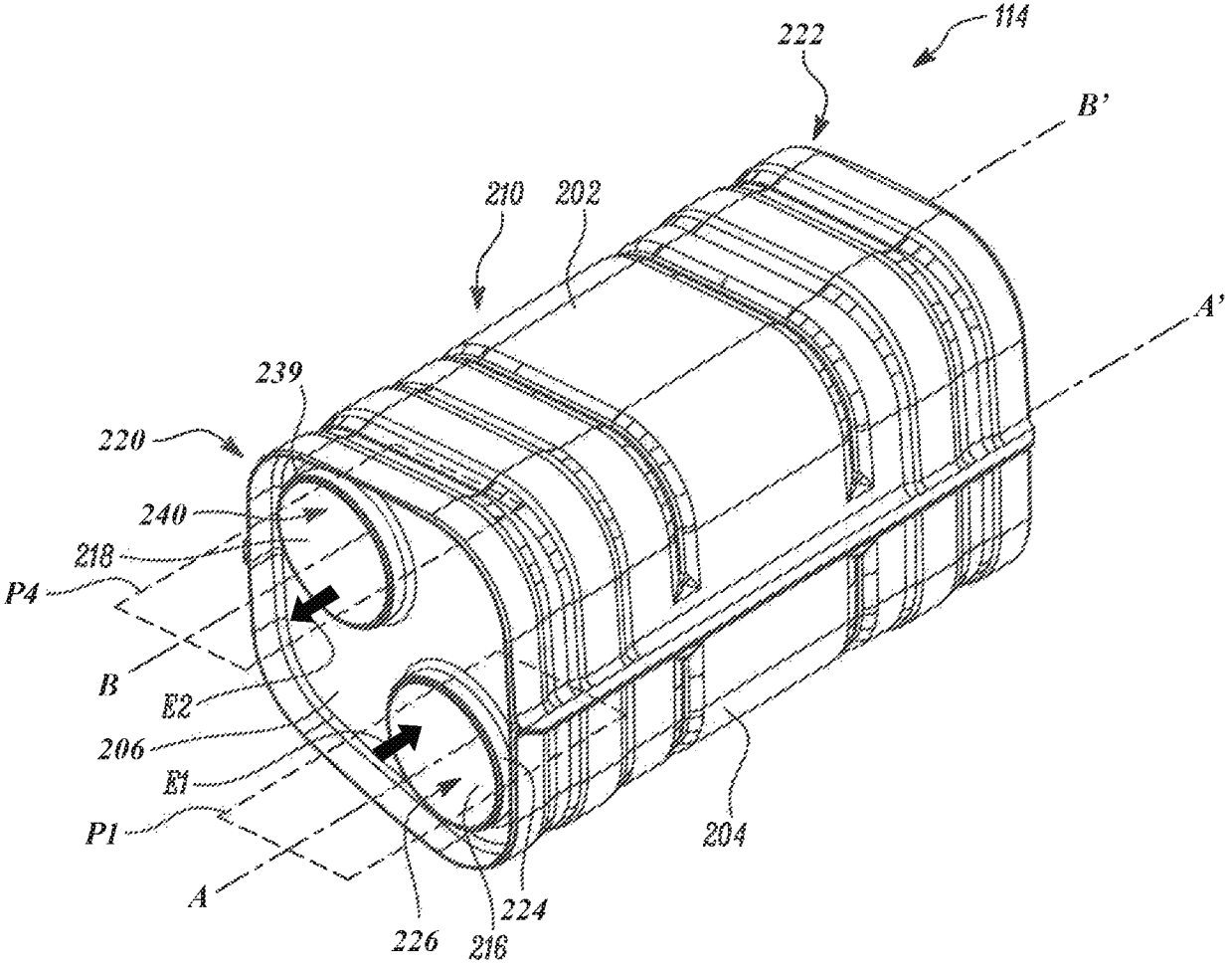
FIG. 2B is a perspective view of the muffler of FIG. 2A in an assembled condition, according to an aspect of the present disclosure.
Figure 2C:
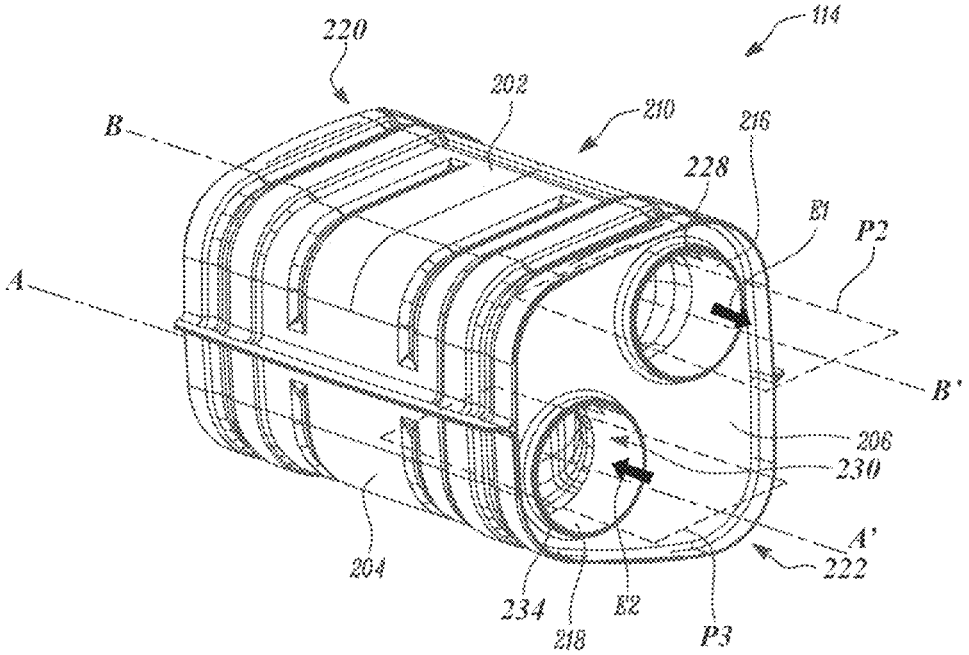
FIG. 2C is another perspective view of the muffler of FIG. 2A in the assembled condition, according to an aspect of the present disclosure.
Figure 2D:
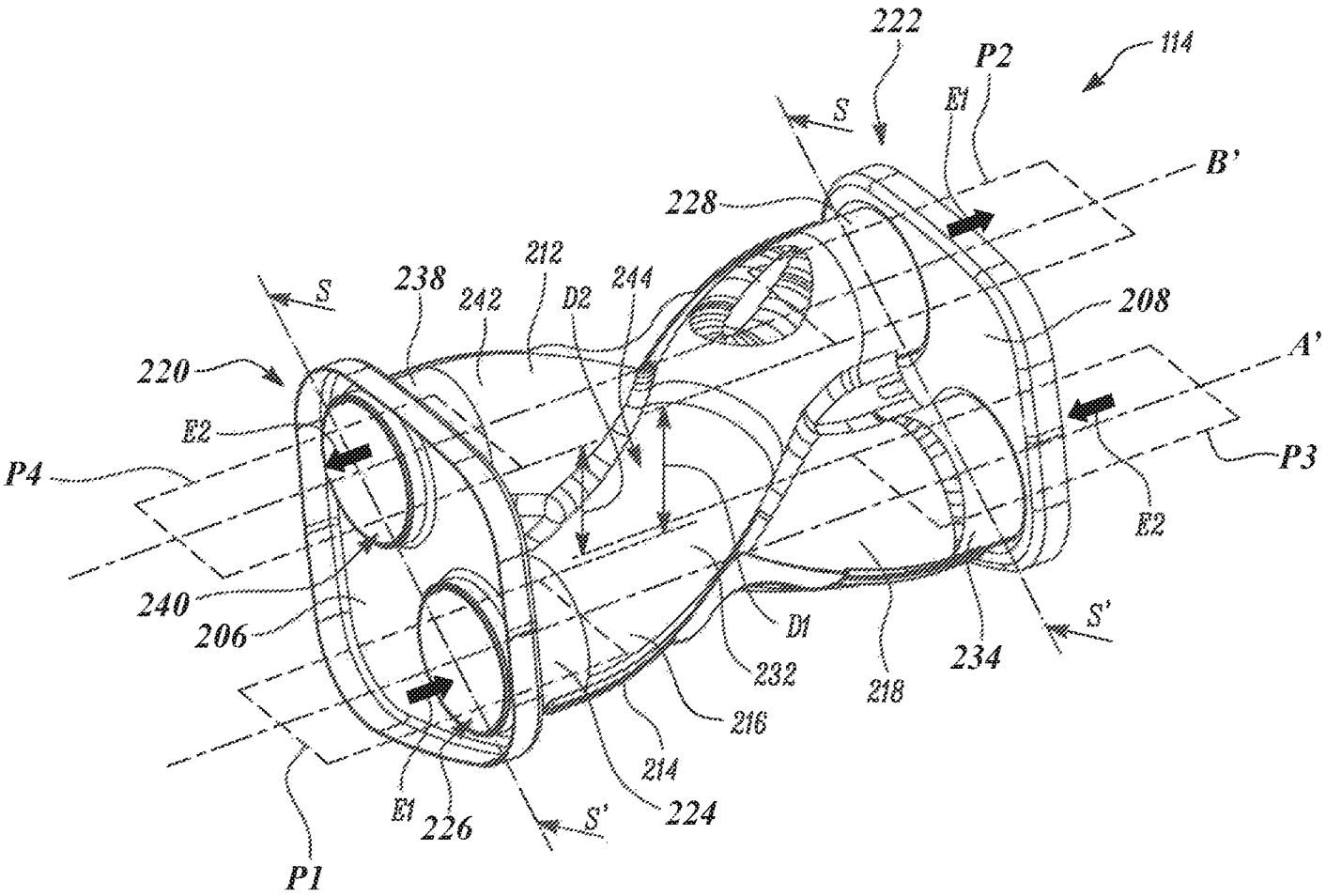
FIG. 2D is another perspective view of the muffler of FIG. 2B without a casing, according to an aspect of the present disclosure.
Figure 2E:
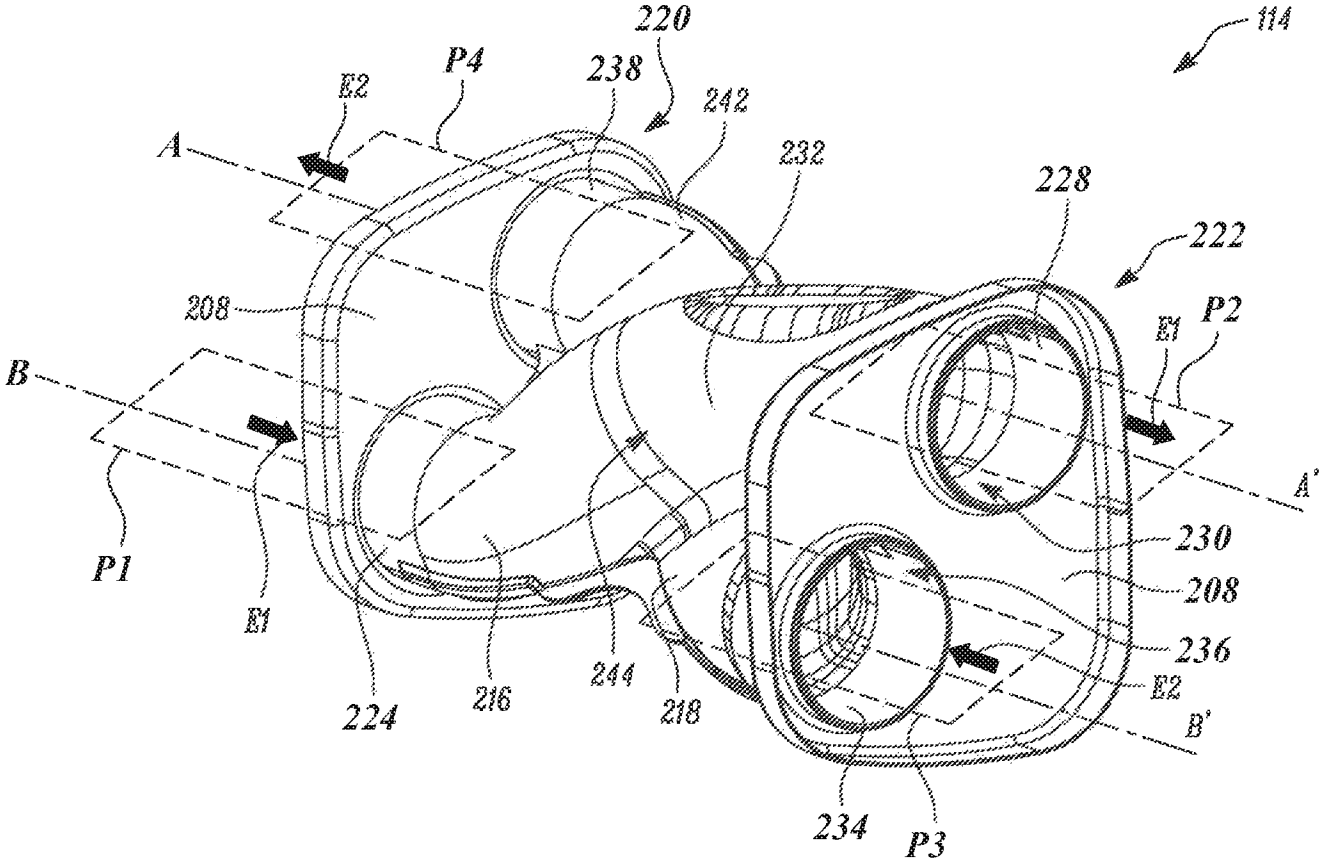
FIG. 2E is another perspective view of the muffler of FIG. 2C without the casing, according to an aspect of the present disclosure.
Figure 2F:
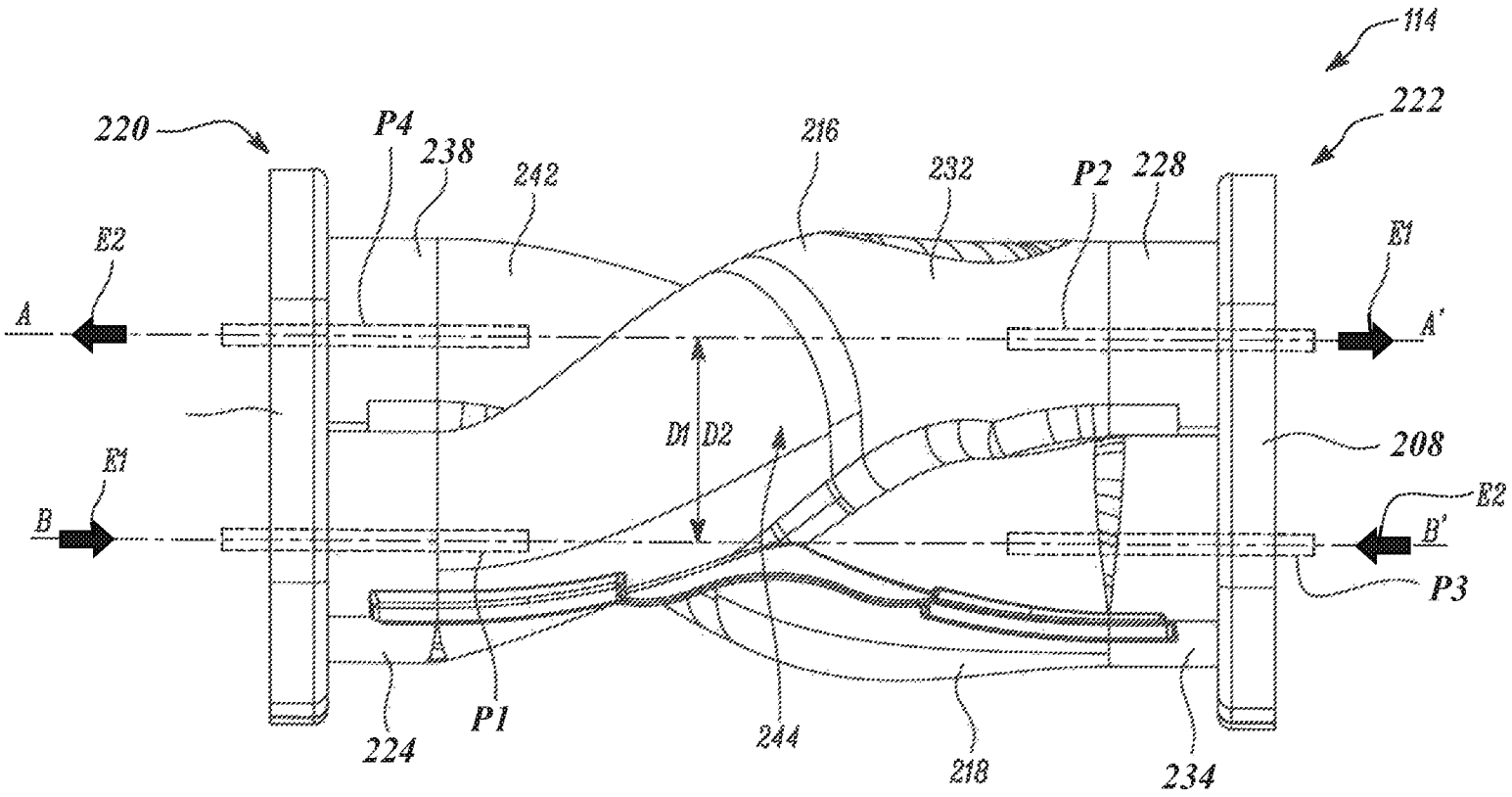
FIG. 2F is a side view of the muffler of FIG. 2E, according to an aspect of the present disclosure.
Figure 2G:
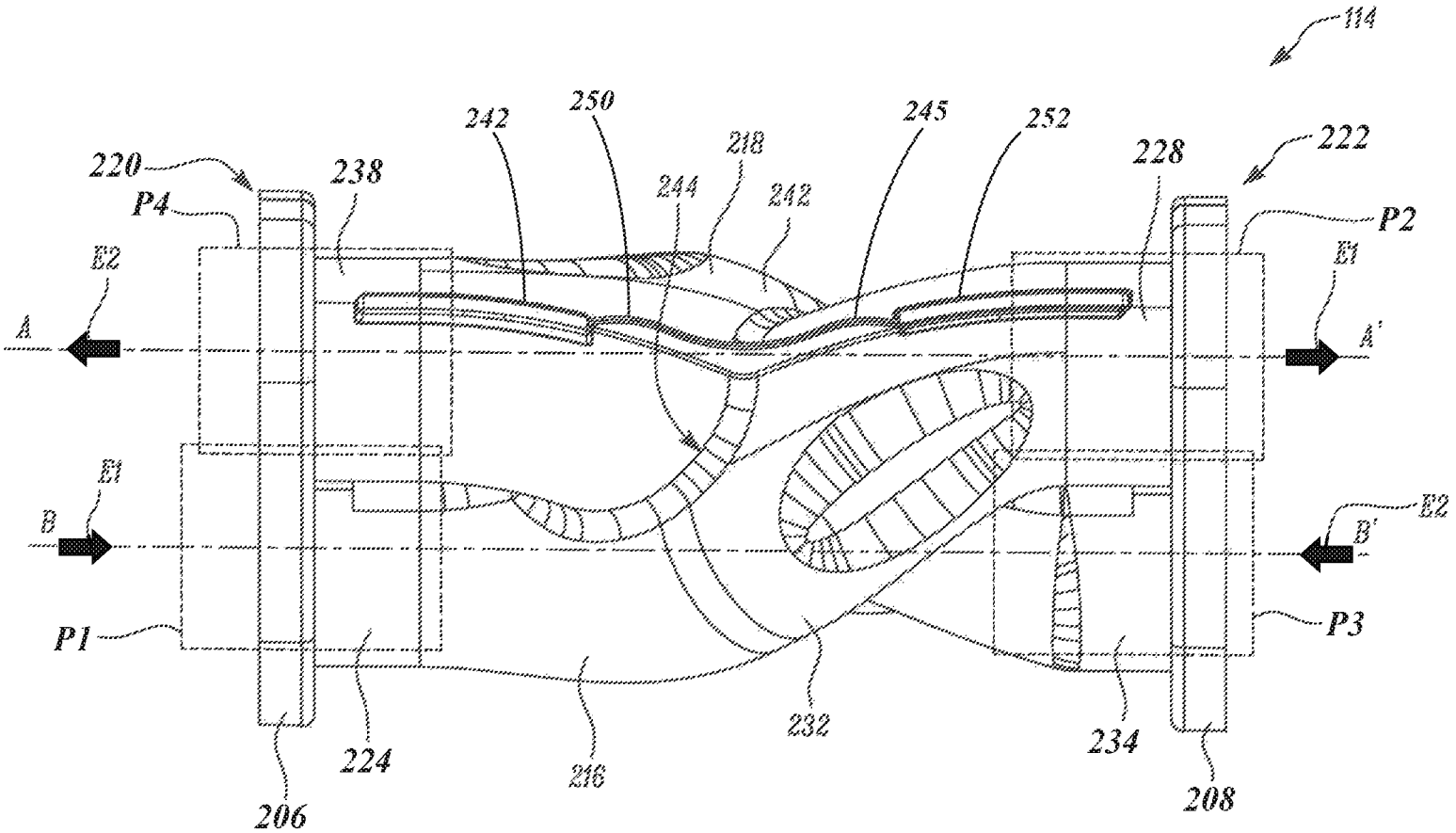
FIG. 2G is a top view of the muffler of FIG. 2E, according to an aspect of the present disclosure.
Figure 2H:
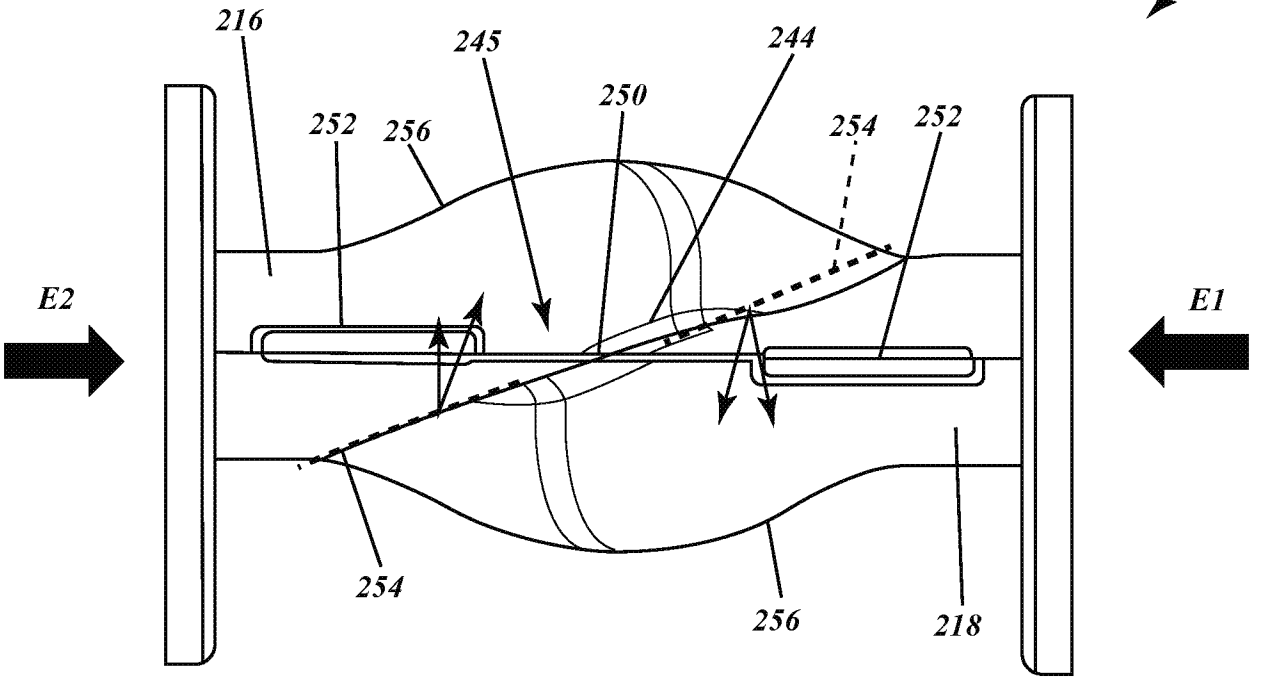
FIG. 2H depicts a side view of the muffler of FIG. 2E, according to an aspect of the present disclosure.

Referring to FIGS. 2B and 2C, different perspective views of the muffler 114 in an assembled position are illustrated. In the illustrated embodiment, the muffler 114 has a substantially elongated and trapezoidal configuration. In other embodiments, the muffler 114 can have any other configurations, such as circular, rectangular, or other configuration based on application requirements. The muffler 114 includes the housing 210. The housing 210 is adapted to at least partially enclose the first inner section 212 and the second inner section 214 of the muffler 114 therein. The housing 210 includes a first end 220 and a second end 222. The second end 222 is disposed opposite to the first end 220. The housing 210 has a substantially hollow configuration and defines a first longitudinal axis A-A' and a second longitudinal axis B-B' of the muffler 114. The first longitudinal axis A-A' and the second longitudinal axis B-B' are parallel to and spaced apart from each other. Also, each of the first longitudinal axis A-A' and the second longitudinal axis B-B' extends between the first end 220 and the second end 222 of the housing 210.

The housing 210 includes the first plate 206 and the second plate 208. The second plate 208 is spaced apart from the first plate 206 along the first longitudinal axis A-A' and the second longitudinal axis B-B'. More specifically, the first plate 206 is disposed on the first end 220 of the housing 210 and the second plate 208 is disposed on the second end 222 of the housing 210. In the illustrated embodiment, the first plate 206 and the second plate 208 are disposed parallel to one another and perpendicular to the first longitudinal axis A-A' and the second longitudinal axis B-B'. In other embodiments, one or more of the first plate 206 and the second plate 208 can be inclined relative to the first longitudinal axis A-A' and the second longitudinal axis B-B'. The housing 210 also includes the first casing 202 and the second casing 204. Each of the first casing 202 and the second casing 204 extends between the first plate 206 and the second plate 208. Each of the first casing 202 and the second casing 204 is adapted to at least partly enclose the first tube 216 and the second tube 218.

The muffler 114 will now be explained with combined reference to FIGS. 2D to 2G. The muffler 114 includes the first tube 216. The first tube 216 is adapted to be fluidly coupled to the first pipe 116. The first tube 216 includes a first inlet portion 224. The first inlet portion 224 is disposed within an aperture 258 (shown in FIG. 2A) provided on the first plate 206. The first inlet portion 224 defines a first inlet 226 of the first tube 216. The first inlet portion 224 is adapted to be fluidly coupled to the first pipe 116. Accordingly, the first tube 216 is adapted to receive the first exhaust stream "E1" from the first pipe 116 into the first tube 216 via the first inlet 226 of the first inlet portion 224.

In the illustrated embodiment, the first inlet portion 224 has a substantially straight configuration. In other embodiments, the first inlet portion 224 can have any other configuration, such as a curved configuration or an angled configuration. The first inlet portion 224 is disposed along a first axial plane "P1". In the illustrated embodiment, the first axial plane "P1" is disposed along the first longitudinal axis A-A'. As such, in the illustrated embodiment, the first axial plane "P1" is substantially parallel to the first longitudinal axis A-A'. In other embodiments, the first axial plane "P1" can be inclined relative to the first longitudinal axis A-A'. Also, in other embodiments, the first axial plane "P1" can be spaced apart from the first longitudinal axis A-A'.

The first tube 216 also includes a first outlet portion 228. The first outlet portion 228 is disposed within an aperture 260 (shown in FIG. 2A) provided on the second plate 208. The first outlet portion 228 defines a first outlet 230 of the first tube 216. The first outlet portion 228 is adapted to be fluidly coupled to the downstream component, such as the first auxiliary muffler 120, or can be open to atmosphere. Accordingly, the first tube 216 is adapted to release the first exhaust stream "E1" from the first tube 216 into the first auxiliary muffler 120 or atmosphere via the first outlet 230 of the first outlet portion 228. In the illustrated embodiment, the first outlet portion 228 has a substantially straight configuration. In other embodiments, the first outlet portion 228 can have any other configuration, such as a curved configuration, an angled configuration, or other configuration based on application requirements.

The first outlet portion 228 is disposed along a second axial plane "P2". In the illustrated embodiment, the second axial plane "P2" is disposed along the second longitudinal axis B-B'. As such, in the illustrated embodiment, the second axial plane "P2" is substantially parallel to the second longitudinal axis B-B' and the first axial plane "P1". In other embodiments, the second axial plane "P2" can be inclined relative to the second longitudinal axis B-B'. Also, in other embodiments, the second axial plane "P2" can be spaced apart from the second longitudinal axis B-B'. Additionally, in the illustrated embodiment, the second axial plane "P2" is vertically spaced from the first axial plane "P1" by a distance "D1". In other embodiments, the second axial plane "P2" and the first axial plane "P1" can be coplanar, based on application requirements.

The first tube 216 further includes a first intermediate portion 232. The first intermediate portion 232 extends from the first inlet portion 224 to the first outlet portion 228. As such, the first intermediate portion 232 is fluidly coupled to the first inlet portion 224 and the first outlet portion 228. The first intermediate portion 232 is adapted to allow flow of the first exhaust stream "E1" from the first inlet portion 224 to the first outlet portion 228. In the illustrated embodiment, the first intermediate portion 232 has a substantially curved configuration. More specifically, the first intermediate portion 232 extends away from the first inlet portion 224, such that the first intermediate portion 232 bends perpendicularly relative to the first axial plane "P1' and the first longitudinal axis A-A', and also laterally relative to the first axial plane "P1' and the first longitudinal axis A-A' in order to align with the second longitudinal axis B-B'. Further, the first intermediate portion 232 bends toward the second longitudinal axis B-B' and the second axial plane "P2" in order to align with the first outlet portion 228. Accordingly, the first intermediate portion 232 extends between the first axial plane "P1" and the second axial plane "P2" vertically spaced by the distance "D1". In other embodiments, the first intermediate portion 232 can have any other configuration, such as an angled configuration, a straight configuration, or other configuration based on application requirements.

The muffler 114 also includes the second tube 218. The second tube 218 is adapted to be fluidly coupled to the second pipe 118. The second tube 218 includes a second inlet portion 234. The second inlet portion 234 is disposed within an aperture 262 (shown in FIG. 2A) provided on the second plate 208. The second inlet portion 234 defines a second inlet 236 of the second tube 218. The second inlet portion 234 is adapted to be coupled to the second pipe 118. Accordingly, the second tube 218 is adapted to receive the second exhaust stream "E2" from the second pipe 118 into the second tube 218 via the second inlet 236 of the second inlet portion 234. In the illustrated embodiment, the second inlet portion 234 has a substantially straight configuration. In other embodiments, the second inlet portion 234 can have any other configuration, such as a curved configuration, an angled configuration, or other configuration based on application requirements. The second inlet portion 234 is disposed along a third axial plane "P3". In the illustrated embodiment, the third axial plane "P3" is disposed along the first longitudinal axis A-A'. Accordingly, the second inlet portion 234 is spaced apart from the first inlet portion 224 along the first longitudinal axis A-A'. Also, in the illustrated embodiment, the third axial plane "P3" is substantially parallel to the first longitudinal axis A-A'. In other embodiments, the third axial plane "P3" can be inclined relative to the first longitudinal axis A-A'. Also, in other embodiments, the third axial plane "P3" can be spaced apart from the first longitudinal axis A-A'.

In the illustrated embodiment, the third axial plane "P3" and the first axial plane "P1" are coplanar. Accordingly, the third axial plane "P3" is vertically spaced from the second axial plane "P2" by the distance "D1". In other embodiments, the third axial plane "P3" can be spaced apart from the first axial plane "P1". Also, in the illustrated embodiment, the third axial plane "P3" is parallel to each of the first axial plane "P1" and the second axial plane "P2". In other embodiments, the third axial plane "P3" can be inclined relative to one or more of the first axial plane "P1" and the second axial plane "P2".

The second tube 218 also includes a second outlet portion 238. The second outlet portion 238 is disposed within an aperture 264 (shown in FIG. 2A) provided on the first plate 206. The second outlet portion 238 defines a second outlet 240 of the second tube 218. The second outlet portion 238 is adapted to be fluidly coupled to the downstream component, such as the second auxiliary muffler 122, or can be open to atmosphere. Accordingly, the second tube 218 is adapted to release the second exhaust stream "E2" from the second tube 218 into the second auxiliary muffler 122 or atmosphere via the second outlet 240 of the second outlet portion 238. In the illustrated embodiment, the second outlet portion 238 has a substantially straight configuration. In other embodiments, the second outlet portion 238 can have any other configuration, such as a curved configuration, an angled configuration, or other configuration based on application requirements.

The second outlet portion 238 is disposed along a fourth axial plane "P4". In the illustrated embodiment, the fourth axial plane "P4" is disposed along the second longitudinal axis B-B'. Accordingly, the second outlet portion 238 is spaced apart from the first outlet portion 228 along the second longitudinal axis B-B'. Also, in the illustrated embodiment, the fourth axial plane "P4" is substantially parallel to the second longitudinal axis B-B'. In other embodiments, the fourth axial plane "P4" can be inclined relative to the second longitudinal axis B-B'. Also, in other embodiments, the fourth axial plane "P4" can be disposed spaced apart from the second longitudinal axis B-B'. Additionally, in the illustrated embodiment, the fourth axial plane "P4" is vertically spaced from the third axial plane "P3" by a distance "D2". In the illustrated embodiment, the distance "D2" is approximately equal to the distance "D1" between the first axial plane "P1" and the second axial plane "P2". In other embodiments, the fourth axial plane "P4" and the third axial plane "P3" can be coplanar, based on application requirements.

In the illustrated embodiment, the fourth axial plane "P4" and the second axial plane "P2" are coplanar. Accordingly, the fourth axial plane "P4" is vertically spaced from the first axial plane "P1" by the distance "D1". In other embodiments, the fourth axial plane "P4" can be spaced apart from the second axial plane "P2". Also, in the illustrated embodiment, the fourth axial plane "P4" is parallel to each of the first axial plane "P1", the second axial plane "P2", and the third axial plane "P3". In other embodiments, the fourth axial plane "P4" can be inclined relative to one or more of the first axial plane "P1", the second axial plane "P2", and the third axial plane "P3".

The second tube 218 further includes a second intermediate portion 242. The second intermediate portion 242 extends from the second inlet portion 234 to the second outlet portion 238. As such, the second intermediate portion 242 is fluidly coupled to the second inlet portion 234 and the second outlet portion 238. The second intermediate portion 242 is adapted to allow flow of the second exhaust stream "E2" from the second inlet portion 234 to the second outlet portion 238. In the illustrated embodiment, the second intermediate portion 242 has a substantially curved configuration. More specifically, the second intermediate portion 242 extends away from the second inlet portion 234, such that the second intermediate portion 242 bends perpendicularly relative to the third axial plane "P3' and the first longitudinal axis A-A', and also laterally relative to the third axial plane "P3' and the first longitudinal axis A-A' in order to align with the second longitudinal axis B-B'. Further, the second intermediate portion 242 bends toward the second longitudinal axis B-B' and the fourth axial plane "P4" in order to align with the second outlet portion 238. Accordingly, the second intermediate portion 242 extends between the third axial plane "P3" and the fourth axial plane "P4" vertically spaced by the distance "D2". In other embodiments, the second intermediate portion 242 can have any other configuration, such as an angled configuration, a straight configuration, or other configuration based on application requirements.

Additionally, the first intermediate portion 232 and the second intermediate portion 242 are disposed in manner such that the first intermediate portion 232 and the second intermediate portion 242 cross each other. Also, the first intermediate portion 232 and the second intermediate portion 242 are at least partially stacked on each other defining a substantially twisted X-shaped configuration of the first intermediate portion 232 and the second intermediate portion 242. As such, crossing and stacking of the first intermediate portion 232 and the second intermediate portion 242 provides a substantially separate flow path for each of the first exhaust stream "E1" and the second exhaust stream "E2" flowing in substantially opposite direction without complete interaction and mixing of the first exhaust stream "E1" with the second exhaust stream "E2" within the muffler 114. Further, the first intermediate portion 232 and the second intermediate portion 242 are fluidly coupled to each other. Accordingly, a common chamber 244 is defined within each of the first intermediate portion 232 and the second intermediate portion 242. The common chamber 244 is adapted to provide at least partial interaction and mixing of the first exhaust stream "E1" with the second exhaust stream "E2".

Figure 2I:
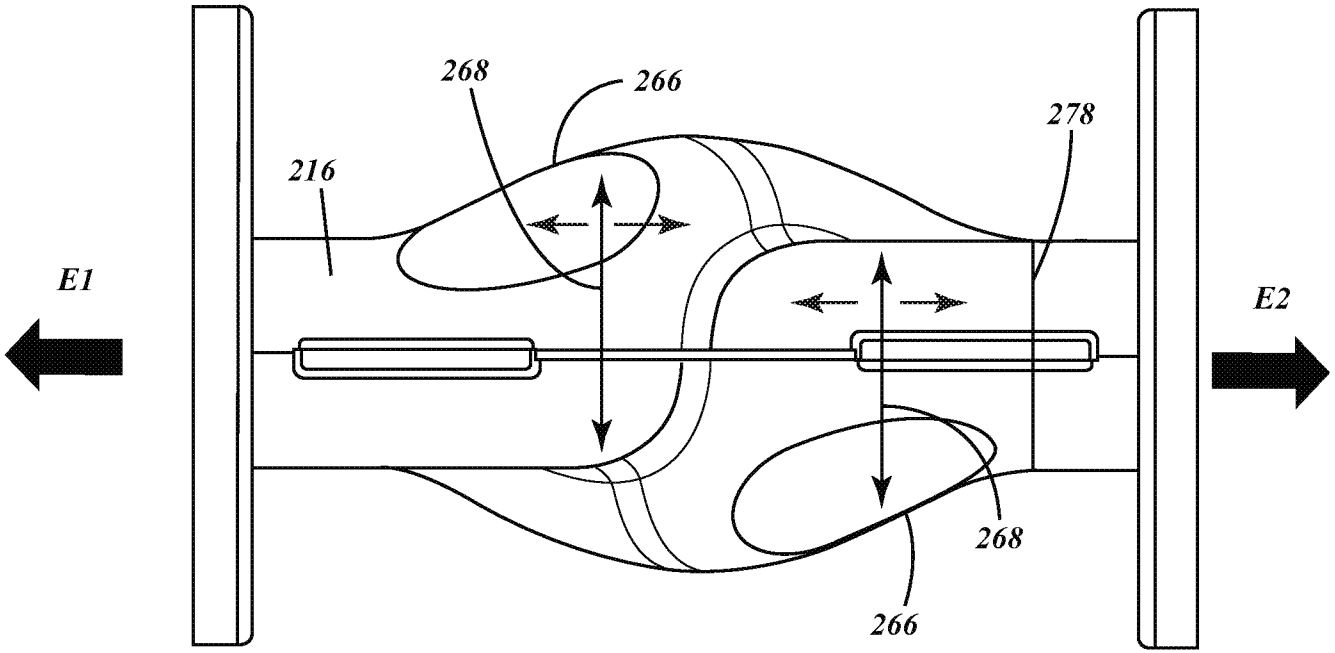
FIG. 2I depicts a side view of the muffler of FIG. 2E, according to an aspect of the present disclosure.
Figure 2J:
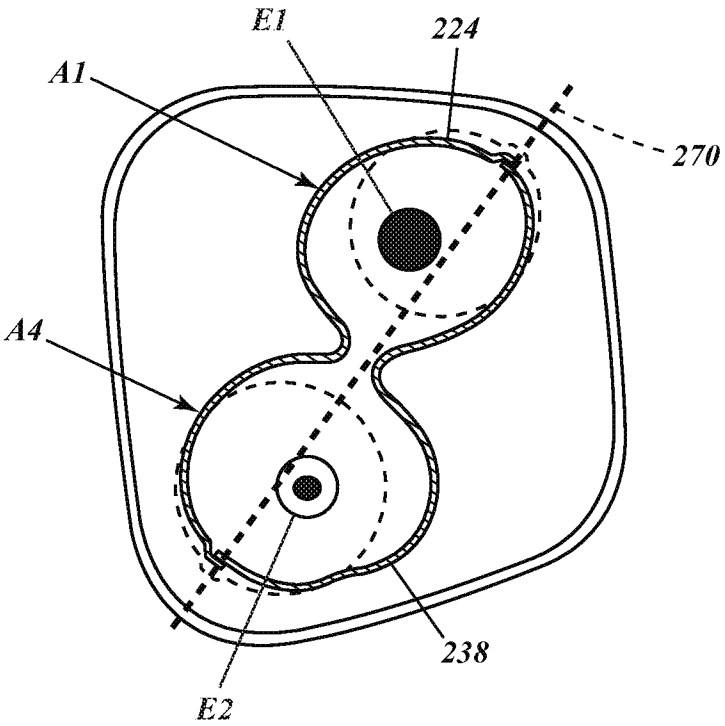
FIG. 2J depicts a side view of the muffler of FIG. 2E, according to an aspect of the present disclosure.
Figure 2J:
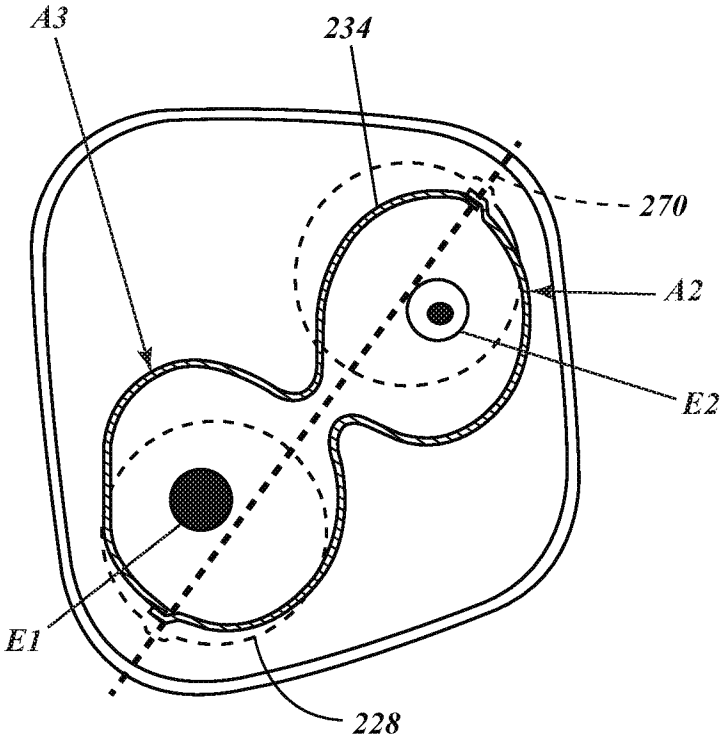

FIGS. 2H-J depict structural improvements to the muffler due to issues caused by joining the two sections 212, 214 by the welded continuous relief 245 that traverses the outside surface of the tubes 216, 218 and joins the two tubes 216, 218 together. The addition of the continuous relief 245 causes flow mixing to have a negative effect on mixing performance. In other words, adding the continuous relief 245 could cause the two exhaust streams, E1 and E2 to collide, which negatively impacts mixing performance. Thus, the structural changes depicted in FIGS. 2H-J change the exhaust stream E1, E2 path flows to minimize collision of flow in the common chamber 244, thus increasing mixing performance.

FIG. 2H depicts a side view of the muffler 114 and illustrates inlet ramps 254 on each of the tubes 216, 218 of the muffler 114. The inlet ramps 254 can be positioned to deflect exhaust stream E1, E2 that enters each tube 216, 218 away from the center of common chamber 244. In other words, the exhaust stream E1, E2 of each tube 216, 218 is deflected toward the outer peripheral surface 256 of each tube 214, 216 thereby helping improve or reduce collisions of the two exhaust streams E1, E2 from the tubes 214, 216.

FIG. 2I depicts a side view of the muffler 114 and illustrates an outer peripheral surface 266 in the shape of a ramp that defines the shape of the tubes 216, 218 of the muffler 114. As illustrated, each tube 216, 218 has ramp that defines a changing, non-uniform cross section as it transitions away from the common chamber 244 toward each outlet 228, 238. While it should be recognized the outer peripheral surface 266 is shown on the outlet side of the common chamber 244, it could also be positioned on the intel side. Each tube 216, 218 starts at the inlets 224, 234 and outlets 228, 238 as a uniform cylindrical aperture and transitions along the peripheral surfaces 256, 266, which causes the tubes 216, 218 as it approaches the common chamber 244 to have a changing, non-uniform cross-sectional area as designated by arrows 268 (showing the outlet side). In other words, the tubes 216, 218 can be an elliptical shape at the common chamber 244 and can transition to a cylinder shape at the inlets 224, 234 and outlets 228, 238. As exhaust stream flow to and from the common chamber 244, the changing, non-uniform cross-section 268 defined by the outer peripheral surfaces 256, 266 reduces flow noise at because the elliptical shape allows exhaust gases E1, E2 to flow near the outer peripheral surfaces 256, 266 and away from the center of the common chamber 244.

Figure 3:
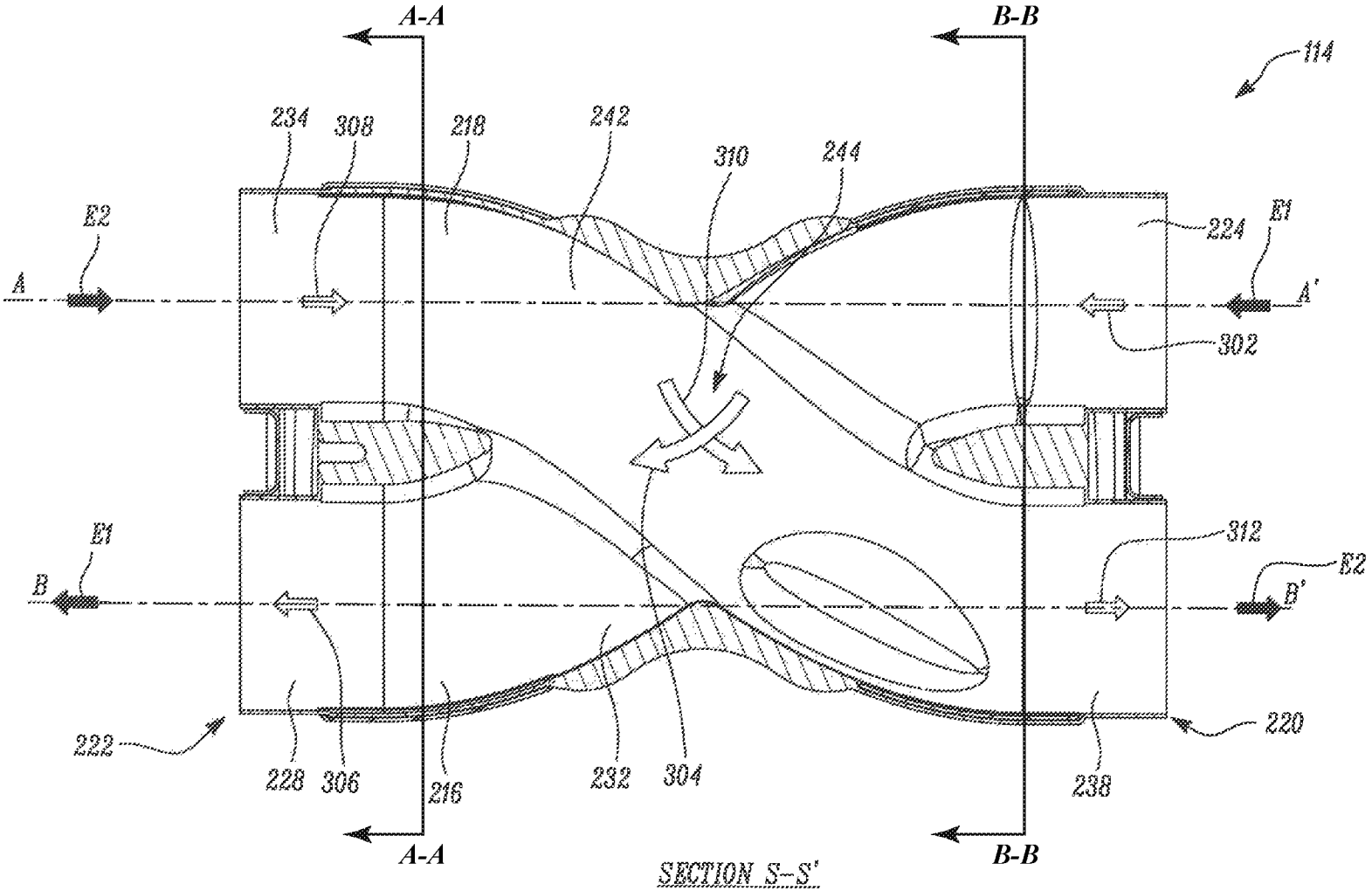
FIG. 3 is a cross-sectional view of the muffler of FIG. 2D along a section S-S', according to an aspect of the present disclosure.

FIG. 2J shows the inlets and outlets at each tube 216, 218 end of the muffler 114 as depicted through cross-section A-A and B-B of FIG. 3. In end view A-A, E1 is illustrative of exhaust stream exiting the muffler and E2 is illustrative of exhaust stream entering the muffler. In end view B-B, E2 is illustrative of exhaust stream exiting the muffler and E1 is illustrative of exhaust stream entering the muffler. As illustrated, the area A1 near the inlet 224 is less than the area A4 near the outlet 238 through cross section B-B. Similarly, the area A2 near the inlet 234 is less than the area A3 near the outlet 228 through cross section A-A. Additionally, the centroid of each area can be offset from the centerline 270, which allows the exhaust streams E1, E2 to be redirected away from the center of the common chamber 244, thereby helping improve or reduce collisions of the two exhaust streams E1, E2 from the tubes 216, 218.

Referring to FIG. 3, during operation of the exhaust system 102, the muffler 114 receives the first exhaust stream "E1" from the first pipe 116, as shown by an arrow 302. The first exhaust stream "E1" enters the first tube 216 via the first inlet 226 of the first inlet portion 224, as shown by the arrow 302. The first exhaust stream "E1" then flows through the first intermediate portion 232 and the common chamber 244, as shown by an arrow 304. Further, the first exhaust stream "E1" flows through the first outlet portion 228 and out of the muffler 114 via the first outlet 230 of the first outlet portion 228, as shown by an arrow 306. Also, the muffler 114 receives the second exhaust stream "E2" from the second pipe 118, as shown by an arrow 308. The second exhaust stream "E2" enters the second tube 218 via the second inlet 236 of the second inlet portion 234, as shown by the arrow 308. The second exhaust stream "E2" then flows through the second intermediate portion 242 and the common chamber 244, as shown by an arrow 310. Further, the second exhaust stream "E2" flows through the second outlet portion 238 and out of the muffler 114 via the second outlet 240 of the second outlet portion 238, as shown by an arrow 312.

As the first exhaust stream "E1" and the second exhaust stream "E2" cross each other in the common chamber 244, the first intermediate portion 232 and the second intermediate portion 242 provide substantially separate flow paths for the first exhaust stream "E1" and the second exhaust stream "E2". As such, due to flow of the first exhaust stream "E1" and the second exhaust stream "E2" in different axial planes complete interaction and mixing of the first exhaust stream "E1" and the second exhaust stream "E2" is limited, in turn, reducing drag and backpressure within the muffler 114. Also, as the first exhaust stream "E1" and the second exhaust stream "E2" cross each other in the common chamber 244, the common chamber 244 provides limited interaction and mixing of the first exhaust stream "E1" and the second exhaust stream "E2", in turn, cancelling half engine order noise generated in each of the first pipe 116 and the second pipe 118 of the exhaust system 102 and reducing fluid noise within the muffler 114. As a result, an overall exhaust noise is reduced downstream of the muffler 114 relative to a conventional muffler having substantial interaction and mixing of different exhaust streams therein.

The muffler 114 provides a simple, efficient, and cost-effective method of reducing exhaust noise downstream of each of the first pipe 116 and the second pipe 118. The muffler 114 includes the first tube 216 and the second tube 218 providing substantially separate flow path for each of the first exhaust stream "E1" and the second exhaust stream "E2". As such, direct collision between the first exhaust stream "E1" and the second exhaust stream "E2" is reduced, in turn, reducing drag and backpressure within the muffler 114. More specifically, the first intermediate portion 232 and the second intermediate portion 242 provide crossing of the first exhaust stream "E1" and the second exhaust stream "E2" via the common chamber 244 without direct collision of opposing flows of the first exhaust stream "E1" and the second exhaust stream "E2".

Also, the curved configuration of each of the first intermediate portion 232 and the second intermediate portion 242 provides gradual change in flow direction of the first exhaust stream "E1" and the second exhaust stream "E2", in turn, reducing drag and backpressure within the muffler 114. Additionally, the common chamber 244 provides limited and controlled interaction between portions of the first exhaust stream "E1" and the second exhaust stream "E2", in turn, cancelling half order engine noise and reducing the overall exhaust noise. The muffler 114 can be manufactured using any process, such as stamping, casting, or any other process, in turn, providing ease of manufacturing and reducing costs. The muffler 114 can be retrofitted in any exhaust system, in turn, providing improved usability, flexibility, and compatibility.

While aspects of the present disclosure have been particularly shown and described with reference to the embodiments above, it will be understood by those skilled in the art that various additional embodiments can be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A muffler for use with an internal combustion engine, the muffler comprising:

a first tube configured to receive a first exhaust stream, the first tube including a first inlet portion and a first area, a first outlet portion spaced apart from the first inlet portion and having a first outlet area, and a first intermediate portion extending between the first inlet portion and the first outlet portion;

a second tube configured to receive a second exhaust stream, the second tube including a second inlet portion having a second inlet area, a second outlet portion spaced apart from the second inlet portion having a second outlet area, and a second intermediate portion extending between the second inlet portion and the second outlet portion; and wherein the first intermediate portion and the second intermediate portion cross each other, are at least partially stacked on each other, and are in fluid communication with each other defining a common chamber; and wherein a diameter of the first tube defines a changing, non-uniform cross section of the first tube from the first intermediate portion to the first outlet portion and a diameter of the second tube that defines a changing, non-uniform cross section of the second tube from the second intermediate portion to the second outlet portion.

2. The muffler of claim 1, wherein at least a portion of the first tube and second tube are an elliptical shape.

3. The muffler of claim 2, wherein the elliptical shape defines a portion of the common chamber to allow exhaust streams, to flow away from a center of common mixing chamber.

4. The muffler of claim 1, further comprising an inlet ramp positioned in one of the first tube or second tube to deflect exhaust streams away from a center of common mixing chamber.

5. The muffler of claim 1, wherein:

the first inlet portion is disposed along a first axial plane;

the first outlet portion is disposed along a second axial plane that is vertically spaced from the first axial plane;

the second inlet portion is disposed along a third axial plane; and the second outlet portion is disposed along a fourth axial plane that is vertically spaced from the third axial plane.

6. The muffler of claim 5, wherein the first axial plane, the second axial plane, the third axial plane and the fourth axial plane are parallel to each other.

7. The muffler of claim 1, wherein each of the first intermediate portion and the second intermediate portion has a curved shape.

8. The muffler of claim 1, wherein each of the first inlet portion, the first outlet portion, the second inlet portion, and the second outlet portion has a straight shape.

9. The muffler of claim 1 further includes a first plate adapted to receive each of the first inlet portion of the first tube and the second outlet portion of the second tube.

10. The muffler of claim 9 further includes a second plate adapted to receive each of the first outlet portion of the first tube and the second inlet portion of the second tube.

11. The muffler of claim 9 further includes a casing coupled to each of the first plate and the second plate, the casing at least partly enclosing the first tube and the second tube.

12. A muffler for use with an internal combustion engine, the muffler comprising:

a first tube configured to receive a first exhaust stream, the first tube including a first inlet portion and a first area, a first outlet portion spaced apart from the first inlet portion and having a first outlet area, and a first intermediate portion extending between the first inlet portion and the first outlet portion;

a second tube configured to receive a second exhaust stream, the second tube including a second inlet portion having a second inlet area, a second outlet portion spaced apart from the second inlet portion having a second outlet area, and a second intermediate portion extending between the second inlet portion and the second outlet portion; and wherein the first intermediate portion and the second intermediate portion cross each other, are at least partially stacked on each other, and are in fluid communication with each other and wherein the first inlet area is smaller than the second outlet area and the second inlet area is smaller than the first outlet area.

13. The muffler of claim 12, wherein at least a portion of the first tube and second tube are an elliptical shape.

14. The muffler of claim 13, wherein the elliptical shape defines a portion of the common chamber to allow exhaust streams to flow away from a center of common mixing chamber.

15. The muffler of claim 12, further comprising an inlet ramp positioned in one of the first tube or second tube to deflect exhaust streams away from a center of common mixing chamber.

16. The muffler of claim 12, wherein:

the first inlet portion is disposed along a first axial plane;

the first outlet portion is disposed along a second axial plane that is vertically spaced from the first axial plane;

the second inlet portion is disposed along a third axial plane; and the second outlet portion is disposed along a fourth axial plane that is vertically spaced from the third axial plane.

17. A muffler for use with an internal combustion engine, the muffler comprising:

a first tube including:

a first inlet portion defining a first inlet configured to receive the first exhaust stream, wherein the first inlet portion is disposed along a first axial plane and has a first inlet area;

a first outlet portion defining a first outlet and disposed along a second axial plane, wherein the second axial plane is vertically spaced from the first axial plane and has a first outlet area; and a first intermediate portion extending from the first inlet portion to the first outlet portion, wherein the first intermediate portion is fluidly coupled to the first inlet portion and the first outlet portion; and a second tube including:

a second inlet portion defining a second inlet configured to receive the second exhaust stream and having a second inlet area, wherein the second inlet portion is spaced apart from the first inlet portion and disposed along a third axial plane;

a second outlet portion spaced apart from the first outlet portion and defining a second outlet and having a second outlet area, wherein the second outlet portion is disposed along a fourth axial plane that is vertically spaced from the third axial plane; and a second intermediate portion extending from the second inlet portion to the second outlet portion, wherein the second intermediate portion is fluidly coupled to the second inlet portion, the second outlet portion and the first intermediate portion, wherein the first intermediate portion and the second intermediate portion cross each other and are at least partially stacked on each other defining a common chamber and, wherein a diameter of the first tube has an outer surface that defines a changing, non-uniform cross section of the first tube from the first intermediate portion to the first outlet portion and a diameter of the second tube has an outer surface that defines a changing, non-uniform cross section of the second tube from the second intermediate portion to the second outlet portion.

18. The muffler of claim 17, wherein the first inlet area is smaller than the second outlet area and the second inlet area is smaller than the first outlet area.

19. The muffler of claim 18, wherein at least a portion of the first tube and second tube are an elliptical shape.

20. The muffler of claim 18, further comprising an inlet ramp positioned in one of the first tube or second tube to deflect exhaust streams away from a center of the common chamber.

* * * * *